US011253757B2

(12) United States Patent
Kitagawa

(10) Patent No.: US 11,253,757 B2
(45) Date of Patent: Feb. 22, 2022

(54) GOLF CLUB HEAD

(71) Applicant: BRIDGESTONE SPORTS CO., LTD., Tokyo (JP)

(72) Inventor: Tomonori Kitagawa, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 17/090,113

(22) Filed: Nov. 5, 2020

(65) Prior Publication Data

US 2021/0187367 A1 Jun. 24, 2021

(30) Foreign Application Priority Data

Dec. 20, 2019 (JP) ..... JP2019-230304

(51) Int. Cl.
*A63B 53/04* (2015.01)

(52) U.S. Cl.
CPC ..... *A63B 53/0466* (2013.01); *A63B 53/0408* (2020.08); *A63B 53/0433* (2020.08); *A63B 53/0437* (2020.08)

(58) Field of Classification Search
CPC ..... A63B 53/0466; A63B 53/0437; A63B 53/0433; A63B 53/0408
USPC ..... 473/324–350, 287–292
See application file for complete search history.

(56) References Cited

U.S. PATENT DOCUMENTS 5,272,802 A * 12/1993 Stites, III ..... A63B 53/0466 29/527.2
5,316,298 A * 5/1994 Hutin ..... A63B 53/04 473/332
5,624,331 A * 4/1997 Lo ..... A63B 53/0466 473/345
5,755,624 A * 5/1998 Helmstetter ..... A63B 53/04 473/291
6,929,565 B2 * 8/2005 Nakahara ..... A63B 60/00 473/345
6,945,877 B2 * 9/2005 Kobayashi ..... A63B 53/04 473/345
7,377,861 B2 * 5/2008 Tateno ..... A63B 53/0466 473/345
7,431,668 B2 * 10/2008 Tateno ..... A63B 60/02 473/346
7,445,564 B2 * 11/2008 Kusumoto ..... A63B 60/02 473/346
7,455,597 B2 * 11/2008 Matsunaga ..... A63B 53/0466 473/329
7,658,687 B2 2/2010 Hirano
(Continued)

FOREIGN PATENT DOCUMENTS

JP 4758177 8/2011
JP 5161518 3/2013

*Primary Examiner* — Sebastiano Passaniti
(74) *Attorney, Agent, or Firm* — IPUSA, PLLC

(57) ABSTRACT

A golf club head includes a hollow structure defined by a face, a crown, a sole, and a back. The crown includes a crown thick part on the back side, and the sole includes a sole thick part on the back side. The back includes a back end thinner than the thickest portion of each of the crown thick part and the sole thick part. The crown thick part and the sole thick part are separated by the back including the back end. The crown thick part and the sole thick part lie over and cover at least part of each other to form an overlap part extending in a toe-heel direction in a view in a crown-sole direction.

11 Claims, 5 Drawing Sheets

(56) References Cited

U.S. PATENT DOCUMENTS

| | | | | |
|---|---|---|---|---|
| 7,753,807 | B2 * | 7/2010 | Nakano | A63B 53/0466 473/335 |
| 7,775,906 | B2 * | 8/2010 | Kusumoto | A63B 53/0466 473/342 |
| 7,798,915 | B2 * | 9/2010 | Matsunaga | A63B 53/0466 473/329 |
| 7,819,759 | B2 * | 10/2010 | Matsunaga | A63B 53/0466 473/346 |
| 8,007,369 | B2 * | 8/2011 | Soracco | A63B 53/04 473/332 |
| 8,371,955 | B2 * | 2/2013 | Matsunaga | A63B 53/00 473/290 |
| 8,425,827 | B2 * | 4/2013 | Lee | A63B 60/00 264/314 |
| 8,435,137 | B2 * | 5/2013 | Hirano | A63B 53/0466 473/345 |
| 8,608,591 | B2 * | 12/2013 | Chao | A63B 53/0466 473/345 |
| 8,784,234 | B2 * | 7/2014 | Lacey | A63B 53/04 473/349 |
| 10,118,075 | B2 * | 11/2018 | Cole | A63B 53/0466 |
| 10,888,750 | B2 * | 1/2021 | Stokke | A63B 53/08 |
| 2002/0123394 | A1 * | 9/2002 | Tsurumaki | A63B 53/0466 473/345 |
| 2005/0049081 | A1 * | 3/2005 | Boone | A63B 53/0466 473/346 |
| 2013/0079176 | A1 * | 3/2013 | Kuan | A63B 53/04 473/345 |

* cited by examiner

GOLF CLUB HEAD

CROSS-REFERENCE TO RELATED APPLICATION

This application is based on and claims priority to Japanese patent application No. 2019-230304, filed on Dec. 20, 2019, the entire contents of which are incorporated herein by reference.

BACKGROUND OF THE INVENTION

1. Field of the Invention

The present invention relates to golf club heads.

2. Description of the Related Art

With respect to golf club heads, various techniques have been studied for improving head functions such as easiness in hitting high balls and distance performance. For example, Japanese Patent Nos. 4758177 and 5161518 describe such techniques for improving head functions.

SUMMARY OF THE INVENTION

According to an aspect of the present invention, a golf club head includes a hollow structure defined by a face, a crown, a sole, and a back. The crown includes a crown thick part on the back side, and the sole includes a sole thick part on the back side. The back includes a back end thinner than the thickest portion of each of the crown thick part and the sole thick part. The crown thick part and the sole thick part are separated by the back including the back end. The crown thick part and the sole thick part lie over and cover at least part of each other to form an overlap part extending in a toe-heel direction in a view in a crown-sole direction.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF EMBODIMENTS

Figure 1A:
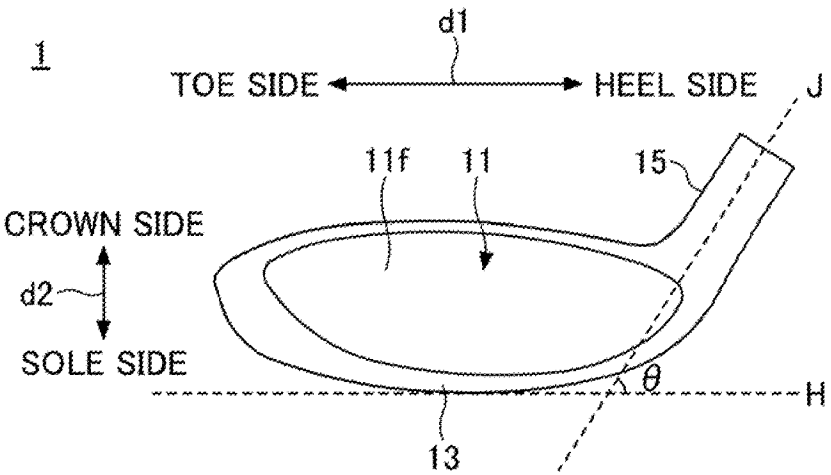
FIGS. 1A through 1D are diagrams illustrating a golf club head according to an embodiment.

To improve head functions of a golf club head, it is desirable that sufficient consideration be given to the position of the center of gravity of the golf club head and it is preferable that there be much freedom in designing the position of the center of gravity of the golf club head.

According to an aspect of the present invention, it is possible to increase freedom in designing the position of the center of gravity of a golf club head.

An embodiment is described below with reference to the accompanying drawings. In the following description, the same components are referred to using the same reference numeral, and duplicate description thereof may be omitted.

FIGS. 1A, 1B, 1C, and 1D are a front view, a plan view, a left side view, and a right side view, respectively, of a golf club head 1 according to the embodiment.

Figure 1B:
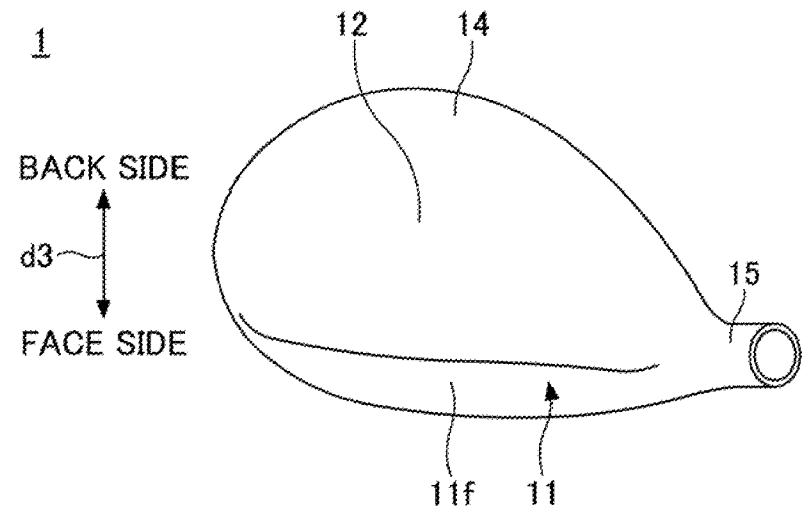
Figure 1C:
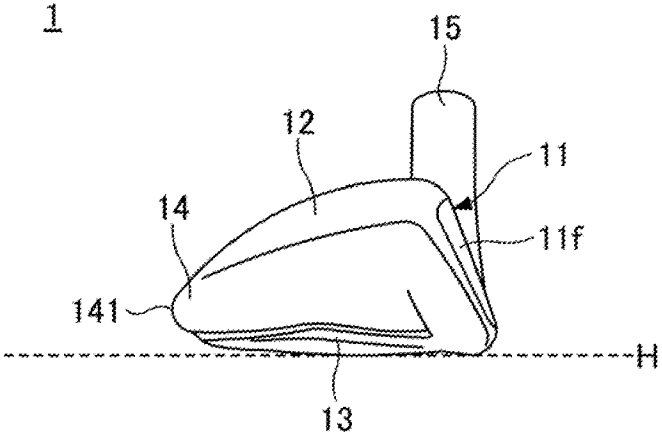
Figure 1D:
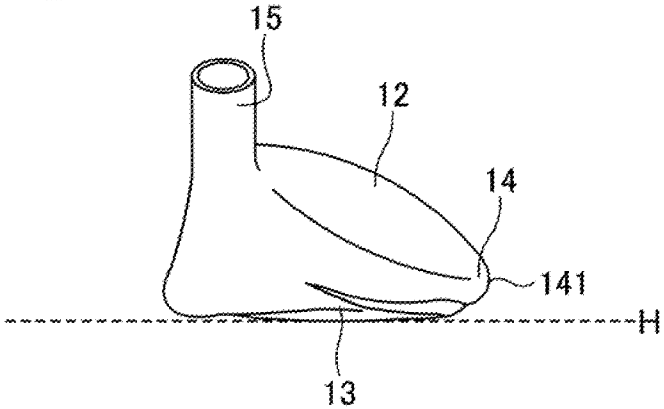

The front elevational view of FIG. 1A is a view taken from the side of a face surface 11*f* of the golf club head 1 (that is, a view looking at the face surface 11*f*), depicting the golf club head 1 resting (soled) on a horizontal plane H (corresponding to a ground surface) at a standard lie angle θ and a standard loft angle (not depicted). In FIG. 1A, the central axis of the bore of a hosel 15 is indicated by the dashed line J. In FIGS. 1A and 1B, the double-headed arrow d1 indicates the "toe-heel" (left-right) direction, namely, the direction from the toe side to the heel side or the direction from the heel side to the toe side, of the golf club head 1, the double-headed arrow d2 indicates the "crown-sole" (up-down) direction, namely, the direction from the crown side to the sole side or the direction from the sole side to the crown side, of the golf club head 1, and the double-headed arrow d3 indicates the "face-back" (front-rear) direction, namely, the direction from the face side to the back side or the direction from the back side to the face side, of the golf club head 1.

The golf club head 1 depicted in FIGS. 1A through 1D is a wood-type golf club head such as a hybrid or fairway wood club head, but may also be a driver club head. The golf club head 1 may be made using, for example, titanium, a titanium alloy, stainless steel, aluminum, an aluminum alloy, a ferrous metal, magnesium, a magnesium alloy, a fiber reinforced resin, or the like. The golf club head 1 is manufactured by, for example, casting. The golf club head 1 is described in more detail below.

The golf club head 1 is a hollow structure that includes a face 11, a crown 12, a sole 13, a back 14, and the hosel 15. An internal surface and an eternal surface of the hollow structure of the golf club head 1 may be referred to as "internal surface" and "external surface," respectively, of the golf club head 1.

The face 11 defines a front portion of the golf club head 1, and includes the face surface 11*f*, which defines a ball-striking surface between the crown 12 and the sole 13 in the crown-sole direction. The face 11 has a predetermined thickness. The face surface 11*f* forms an external surface of the face 11. The crown 12 defines a top portion of the golf club head 1. The sole 13 defines a bottom portion of the golf club head 1. The back 14 extends between the crown 12 and the sole 13 on the opposite side from the face 11, to define a curved periphery of the golf club head 1 that is continuous with the face surface 11*f*. The hosel 15 receives a shaft.

An attachment part (weight port) configured to receive a head weight adjustment component (weight) may be provided in the sole 13. In this case, it is preferable to provide a recess in the sole 13 to prevent the head weight adjustment component attached to the attachment part from protruding from an external surface of the sole 13. Weight adjustment using a weight makes it possible to adjust the position of the center of gravity of the golf club head 1.

Figure 2:
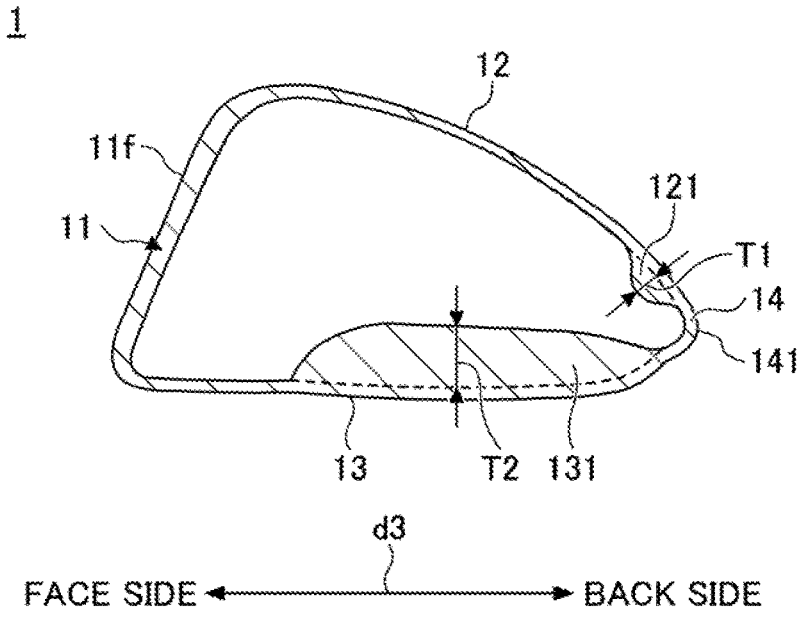
FIG. 2 is a cross-sectional view of the golf club head, taken along a vertical plane extending in a face-back direction.
Figure 3:
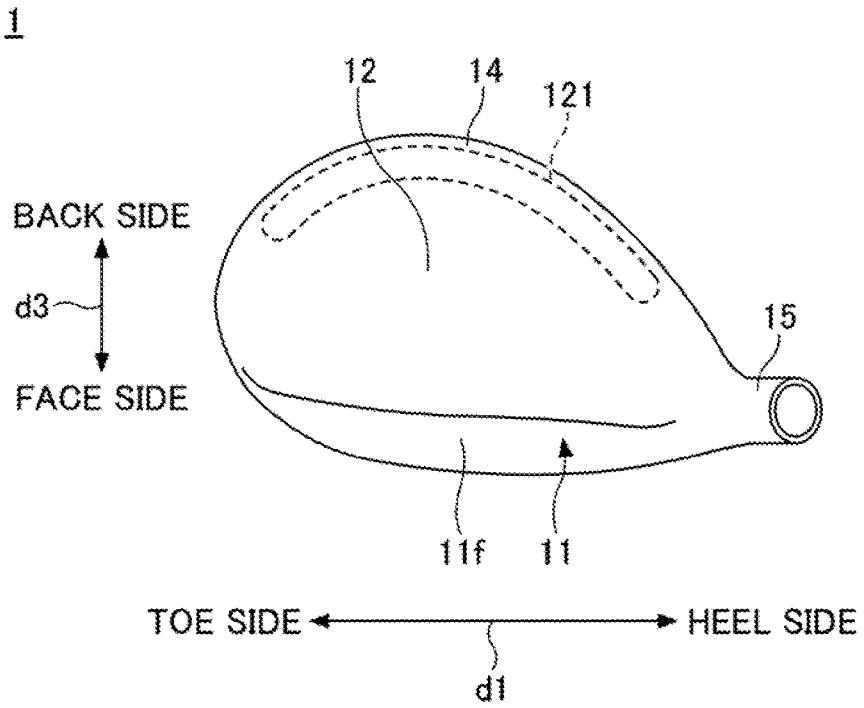
FIG. 3 is a plan view of the golf club head, looking at the golf club head from the crown side in a crown-sole direction.
Figure 4:
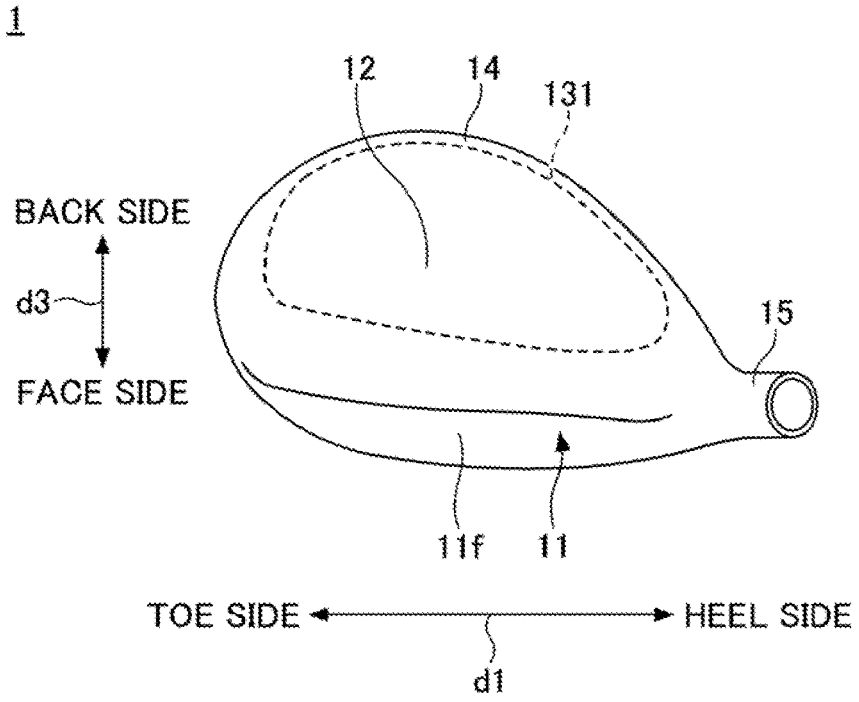
FIG. 4 is a plan view of the golf club head, looking at the golf club head from the crown side in the crown-sole direction.
Figure 5:
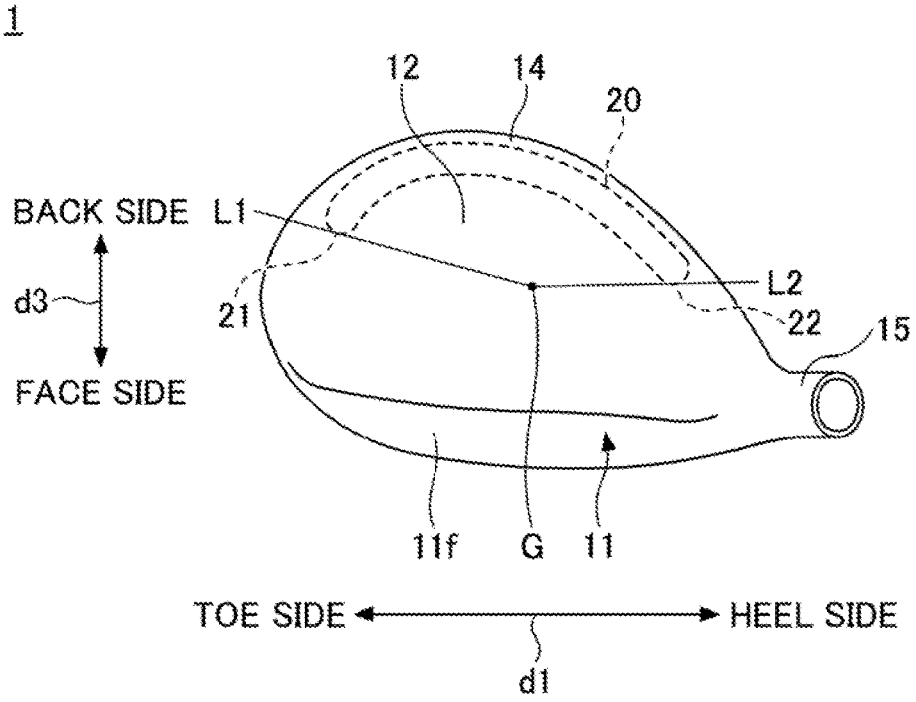
FIG. 5 is a plan view of the golf club head, looking at the golf club head from the crown side in the crown-sole direction.

FIG. 2 is a cross-sectional view of the golf club head 1, taken along a vertical plane extending in the face-back direction. FIGS. 3 through 5 are plan views of the golf club head 1, looking at the golf club head 1 from the crown side in the crown-sole direction. FIG. 3 illustrates the position of a crown thick part 121 in a plan view of the golf club head 1. FIG. 4 illustrates the position of a sole thick part 131 in a plan view of the golf club head 1. FIG. 5 illustrates the position of an overlap part 20 that is an overlap between the crown thick part 121 and the sole thick part 131 in a plan view of the golf club head 1.

Referring to FIGS. 2 and 3, the crown 12 includes the crown thick part 121 in the internal surface on the back side. In a plan view, the crown thick part 121 has a curved strip shape extending in the toe-heel direction along the back-side contour shape of the crown 12.

In FIG. 2, the dashed line contacting the crown thick part 121 indicates where the internal surface of the golf club head 1 would be without the crown thick part 121. The internal surface of the golf club head 1 protrudes inward to form the crown thick part 121, which is thicker than other parts of the crown 12, so that the crown thick part 121 forms a one-piece structure with other parts of the golf club head 1.

It is assumed that in a portion of the crown 12 where the crown thick part 121 is formed, the thickness of the wall of the golf club head 1, namely, the thickness of the golf club head 1 between its external surface and the dashed line in FIG. 2, is equal to the average thickness of the wall of the golf club head 1 in a portion of the crown 12 where the crown thick part 121 is not formed.

A thickness T1 of the thickest portion of the crown thick part 121 is, for example, 1.0 mm or more and 6.0 mm or less. Here, the thickest portion of the crown thick part 121 is where the crown thick part 121 is thickest when the thickness is measured from the external surface of the golf club head 1 in a direction in which a normal to the external surface extends at each point.

Referring to FIGS. 2 and 4, the sole 13 includes the sole thick part 131 in the internal surface on the back side. In a plan view, the sole thick part 131 has a substantially semicircular shape and provided in a region of the sole 13 other than its face side part.

In FIG. 2, the dashed line contacting the sole thick part 131 indicates where the internal surface of the golf club head 1 would be without the sole thick part 131. The internal surface of the golf club head 1 protrudes inward to form the sole thick part 131, which is thicker than other parts of the sole 13, so that the sole thick part 131 forms a one-piece structure with other parts of the golf club head 1.

It is assumed that in a portion of the sole 13 where the sole thick part 131 is formed, the thickness of the wall of the golf club head 1, namely, the thickness of the golf club head 1 between its external surface and the dashed line in FIG. 2, is equal to the average thickness of the wall of the golf club head 1 in a portion of the sole 13 where the sole thick part 131 is not formed.

A thickness T2 of the thickest portion of the sole thick part 131 is, for example, 0.5 mm or more and 8.0 mm or less. Here, the thickest portion of the sole thick part 131 is where the sole thick part 131 is thickest when the thickness is measured from the external surface of the golf club head 1 in a direction in which a normal to the external surface extends at each point.

Referring to FIG. 2, the back 14 includes a back end 141 which is thinner than the thickest portion of each of the crown thick part 121 and the sole thick part 131. The crown thick part 121 and the sole thick part 131 are spaced apart across the back 14 including the back end 141.

The weight of the crown thick part 121 is, for example, 1 g or more and 44 g or less. The weight of the sole thick part 131 is, for example, 5 g or more and 70 g or less. The ratio of the weight of the crown thick part 121 to the weight of the sole thick part 131 is preferably 5% or more and 65% or less. The ratio of the weight of the crown thick part 121 to the weight of the entirety of the golf club head 1 is preferably 0.4% or more and 20% or less. These ratios produce the effect of getting a ball to fly on a high trajectory to stop on the green. The weight of the entirety of the golf club head 1 is, for example, 220 g or more and 270 g or less.

Referring to FIG. 5, when viewed in the crown-sole direction (in a plan view), the crown thick part 121 and the sole thick part 131 lie over and cover at least part of each other to form the overlap part 20 elongated in the toe-heel direction. In a plan view, the overlap part 20 has a curved strip shape extending in the toe-heel direction along the back-side contour shape of the crown 12.

Preferably, 70% or more, more preferably, 80% or more, and still more preferably, 90% or more of the crown thick part 121 overlaps the sole thick part 131. The entirety of the crown thick part 121 may lie over or be covered with the sole thick part 131 to form the overlap part 20 when viewed in the crown-sole direction. As the overlap between the crown thick part 121 and the sole thick part 131 becomes larger, it becomes easier to adjust the position of the center of gravity in the height (up-down) direction without changing the position of the center of gravity in the front-rear direction or the left-right direction.

While having a curved strip shape extending in the toe-heel direction along the back side according to the example of FIG. 5, the overlap part 20 may also have a substantially rectilinear strip shape extending in the toe-heel direction. The curved strip shape, however, is more preferable because it allows a wider weight adjustable range.

Referring to FIG. 5, a toe-side end 21 of the overlap part 20 is a position where a line segment L1 passing through a center of gravity G of the golf club head 1 contacts the overlap part 20 on the toe side in a plan view. Furthermore, a heel-side end 22 of the overlap part 20 is a position where a line segment L2 passing through the center of gravity G contacts the overlap part 20 on the heel side in a plan view. That is, in a plan view, the overlap part 20 is within an area on the back side of the line segments L1 and L2.

Preferably, the overlap part 20 lies on the toe side and on the heel side relative to the center of gravity G. For example, letting the face-back direction be the 6 o'clock-12 o'clock direction with the center of gravity G being at the center (according to an imaginary clock dial or on an imaginary horizontal clock face) in a plan view, for example, the toe-side end 21 is positioned on the 12 o'clock side of 9 o'clock and the heel-side end 22 is positioned on the 12 o'clock side of 3 o'clock.

Preferably, the toe-side end 21 is positioned between 9 o'clock and 12 o'clock and the heel-side end 22 is positioned between 3 o'clock and 12 o'clock. This placement makes it possible to produce the effect of increasing the moment of inertia (MOI) (the MOI increasing effect). More preferably, the toe-side end 21 is positioned between 9 o'clock and 12 o'clock and the heel-side end 22 is positioned between 2 o'clock and 12 o'clock. This placement makes the MOI increasing effect more prominent.

Thus, according to the golf club head 1, the crown 12 has the crown thick part 121 on the back side, the sole 13 has the sole thick part 131 on the back side, and the back 14 has the back end 141 thinner than the thickest portion of each of the crown thick part 121 and the sole thick part 131.

The crown thick part 121 and the sole thick part 131 are separated by the back 14 including the back end 141, and when viewed in the crown-sole direction (in a plan view), the crown thick part 121 and the sole thick part 131 at least overlap each other to form the overlap part 20 extending in the toe-heel direction.

This structure vertically separates the crown thick part 121 and the sole thick part 131. Therefore, it is possible to increase freedom in designing the position of the center of gravity of the golf club head 1. Furthermore, the crown thick part 121 is spaced apart from the sole thick part 131. This facilitates such designing as to prevent the center of gravity of the golf club head 1 from being too low. Furthermore, the presence of the overlap part 20 facilitates adjustment of the position of the center of gravity in the height (up-down) direction without changing the position of the center of gravity in the front-rear direction or the left-right direction.

In particular, application of such a structure to hybrids or fairway woods whose head volume is 300 cc or less which are often used to hit a ball without teeing it up allows design that is likely to cause a ball to launch higher.

[First Variation]

A first variation of the embodiment illustrates an example of a golf club head whose face or crown includes a separate member. In the following description of the first variation, a description of the same elements as those of the above-described embodiment may be omitted.

Figure 6:
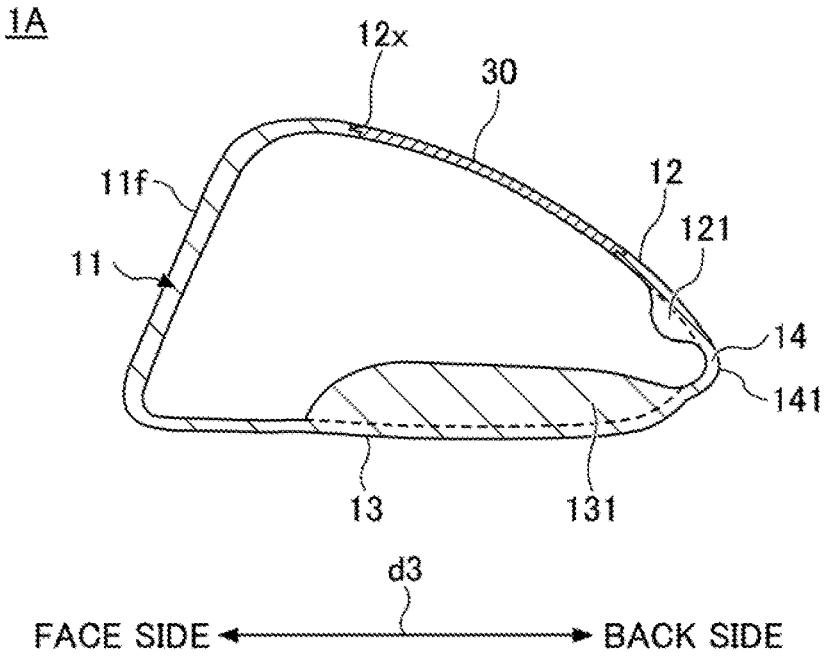
FIG. 6 is a cross-sectional view of another golf club head according to the embodiment, taken along a vertical plane extending in a face-back direction.

FIG. 6 is a cross-sectional view of a golf club head 1A, taken along a vertical plane extending in the face-back direction. Referring to FIG. 6, the golf club head 1A is different from the golf club head 1 (see, for example, FIGS. 1A through 1D and 2) in that an opening 12*x* is provided in part of the crown 12 and that a crown member 30 is joined to the crown 12 at the opening 12*x*.

For example, steps that fit to each other to be positioned are provided one in each of an inner wall surface (opening edge) of the crown 12 defining the opening 12*x* and a sidewall surface (peripheral surface) of the crown member 30. The crown member 30 is joined to the crown 12 within the opening 12*x* to close the opening 12*x*, and defines a top portion of the golf club head 1A together with the crown 12. The crown thick part 121 and the sole thick part 131 are positioned in the body of the golf club head 1 in which the opening 12*x* is provided.

Suitable materials for the crown member 30 include, for example, metal materials, non-metal materials, and materials lower in specific gravity than metal materials. Examples of specific materials for the crown member 30 include titanium, a titanium alloy, stainless steel, aluminum, an aluminum alloy, a ferrous metal, magnesium, a magnesium alloy, and a fiber reinforced resin.

The crown member 30 is joined to the crown 12 by, for example, welding or bonding in such a manner as to close the opening 12*x*. After the crown member 30 is joined to the crown 12 at the opening 12*x*, one or more of processes such as painting, polishing, and machining may be performed on an as-needed basis.

Figure 7:
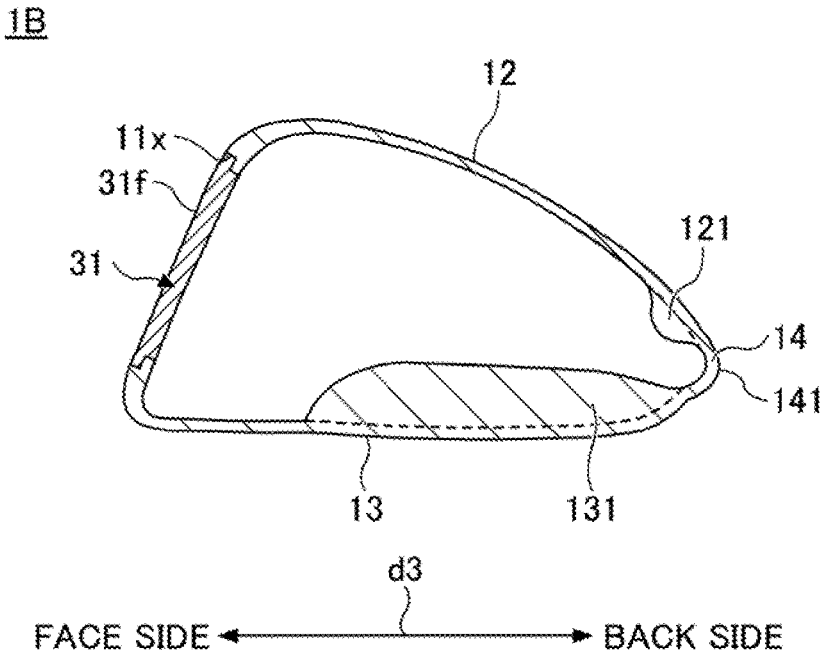
FIG. 7 is a cross-sectional view of yet another golf club head according to the embodiment, taken along a vertical plane extending in a face-back direction.

FIG. 7 is a cross-sectional view of a golf club head 1B, taken along a vertical plane extending in the face-back direction. Referring to FIG. 7, the golf club head 1B is different from the golf club head 1 (see, for example, FIGS. 1A through 1D and 2) in that an opening 11*x* is provided in a face and that a face member 31 is joined to the face at the opening 11*x*.

For example, steps that fit to each other to be positioned are provided one in each of an inner wall surface (opening edge) of the face defining the opening 11*x* and a sidewall surface (peripheral surface) of the face member 31. The face member 31 is joined to the face within the opening 11*x* to close the opening 11*x*, and defines the face including a face surface 31*f*. The crown thick part 121 and the sole thick part 131 are positioned in the body of the golf club head 1 in which the opening 11*x* is provided.

Suitable materials for the face member 31 include, for example, metal materials, non-metal materials, and materials lower in specific gravity than metal materials. Examples of specific materials for the face member 31 include titanium, a titanium alloy, stainless steel, aluminum, an aluminum alloy, a ferrous metal, magnesium, a magnesium alloy, and a fiber reinforced resin.

The face member 31 is joined to the face by, for example, welding or bonding in such a manner as to close the opening 11*x*. After the face member 31 is joined to the face at the opening 11*x*, one or more of processes such as painting, polishing, and machining may be performed on an as-needed basis.

As illustrated in FIGS. 6 and 7, multiple components may be joined to be assembled into a golf club head. This facilitates removal of a core in a mold when manufacturing the body of the golf club head in which the crown thick part 121 and the sole thick part 131 are provided by casting.

Furthermore, providing the crown member 30 as a separate member as in the golf club head 1A makes it possible to select the material and the thickness of the crown member 30 and therefore to further increase freedom in designing the center of gravity in a vertical direction.

Furthermore, providing the face member 31 as a separate member as in the golf club head 1B makes it possible to select a material higher in strength than the body of the golf club head 1 as the face member 31 and therefore to increase the repulsive force of the face member 31 at impact.

[Second Variation]

A second variation of the embodiment illustrates an example of a golf club head in which a crown thick part is provided as a separate member. In the following description of the second variation, a description of the same elements as those of the above-described embodiment may be omitted.

Figure 8:
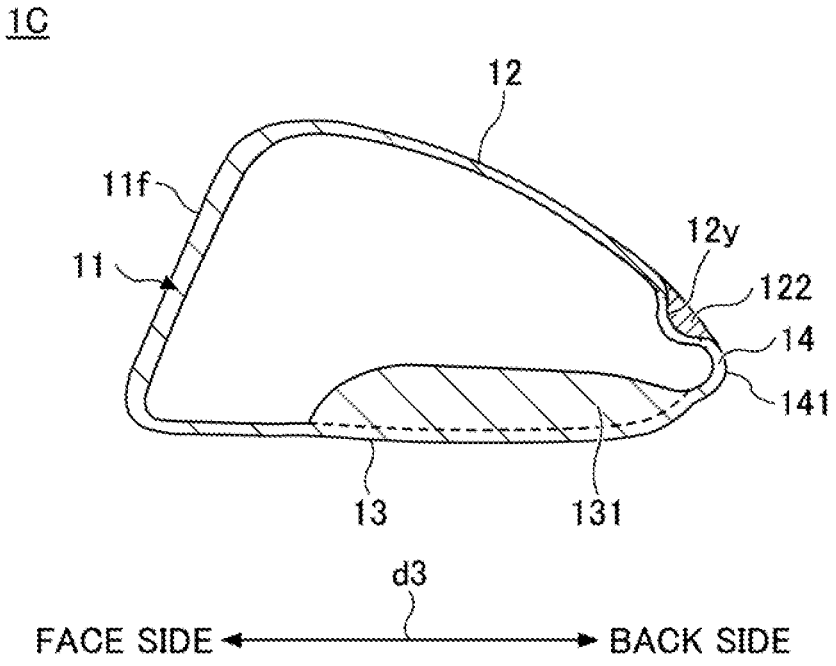
FIG. 8 is a cross-sectional view of still another golf club head according to the embodiment, taken along a vertical plane extending in a face-back direction.

FIG. 8 is a cross-sectional view of a golf club head 1C, taken along a vertical plane extending in the face-back direction. Referring to FIG. 8, the golf club head 1C is different from the golf club head 1 (see, for example, FIGS. 1A through 1D and 2) in that a crown thick part 122 is a member separate from the crown 12.

The external surface of the crown 12 on the back side is depressed inward (namely, toward the internal space of the golf club head 1C) to form a depression 12*y*, in which the crown thick part 122 is placed. Preferably, the crown thick part 122 is formed of a material higher in specific gravity than the crown 12. Examples of such a material include tungsten nickel (W—Ni), a copper alloy, and a lead alloy.

The crown thick part 122 is joined to the crown 12 by, for example, welding, bonding, brazing, bucking or the like in such a manner as to fill in the depression 12*y*. After the crown thick part 122 is joined to the depression 12*y*, one or more of processes such as painting, polishing, and machining may be performed on an as-needed basis.

Thus, according to the golf club head 1C, the crown thick part 122 is a member separate from the crown 12. This makes it possible to select a material higher in specific gravity than the crown 12 as the material of the crown thick part 122 and therefore to further increase freedom in designing the position of the center of gravity of the golf club head 1C.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that various changes, substitutions, and alterations could be made hereto without departing from the spirit and scope of the invention.

What is claimed is:

1. A golf club head for a hybrid or fairway wood club, comprising:

a hollow structure defined by a face, a crown, a sole, and a back, wherein the crown includes a crown thick part on a back side, the sole includes a sole thick part on the back side, the back includes a back end thinner than a thickest portion of each of the crown thick part and the sole thick part, the crown thick part and the sole thick part are separated by the back including the back end, the crown thick part and the sole thick part lie over and cover at least a part of each other to form an overlap part elongated in a toe-heel direction in a view in a crown-sole direction, the crown includes a depression on the back side, and the crown thick part is formed of a material higher in specific gravity than the crown and is placed in the depression.

2. The golf club head as claimed in claim 1, wherein a volume of the golf club head is 300 cc or less.

3. The golf club head as claimed in claim 1, wherein the crown includes a crown member joined to a body of the hollow structure at an opening provided in the body of the hollow structure, and the crown thick part and the sole thick part are positioned in the body of the hollow structure.

4. The golf club head as claimed in claim 1, wherein the face includes a face member joined to a body of the hollow structure at an opening provided in the body of the hollow structure, and the crown thick part and the sole thick part are positioned in the body of the hollow structure.

5. The golf club head as claimed in claim 1, wherein in the view in the crown-sole direction, letting a face-back direction be a 6 o'clock-12 o'clock direction with a center of gravity of the golf club head being at a center, a toe-side end of the overlap part elongated in the toe-heel direction is positioned between 9 o'clock and 12 o'clock and a heel-side end of the overlap part elongated in the toe-heel direction is positioned between 3 o'clock and 12 o'clock.

6. The golf club head as claimed in claim 1, wherein a ratio of a weight of the crown thick part to a weight of an entirety of the golf club head is 0.4% or more and 20% or less.

7. The golf club head as claimed in claim 6, wherein a ratio of the weight of the crown thick part to a weight of the sole thick part is 5% or more and 65% or less.

8. The golf club head as claimed in claim 7, wherein the weight of the crown thick part is 1 g or more and 44 g or less, and the weight of the sole thick part is 5 g or more and 70 g or less.

9. The golf club head as claimed in claim 1, wherein the sole thick part is heavier than the crown thick part.

10. The golf club head as claimed in claim 1, wherein a ratio of a weight of the crown thick part to a weight of the sole thick part is 5% or more and 65% or less.

11. A golf club head for a hybrid or fairway wood club, comprising:

a hollow structure defined by a face, a crown, a sole, and a back, wherein the crown includes a crown thick part on a back side, the sole includes a sole thick part on the back side, the back includes a back end thinner than a thickest portion of each of the crown thick part and the sole thick part, the crown thick part and the sole thick part are separated by the back including the back end, the crown thick part and the sole thick part lie over and cover at least a part of each other to form an overlap part elongated in a toe-heel direction in a view in a crown-sole direction, the crown thick part has a curved strip shape extending in the toe-heel direction along a back-side contour shape of the crown in the view in the crown-sole direction, and the sole thick part has a substantially semicircular shape and provided in a region of the sole other than a face side part thereof in the view in the crown-sole direction.

* * * * *